US011408706B2

(12) United States Patent
Clemen, Jr. et al.

(10) Patent No.: US 11,408,706 B2
(45) Date of Patent: Aug. 9, 2022

(54) APPARATUSES AND METHODS FOR A SUPERCONDUCTING EXPLOSIVE

(71) Applicant: The Boeing Company, Chicago, IL (US)

(72) Inventors: Mark J. Clemen, Jr., Chicago, IL (US); Keith A. Coleman, Chicago, IL (US)

(73) Assignee: The Boeing Company, Chicago, IL (US)

( * ) Notice: Subject to any disclaimer, the term of this patent is extended or adjusted under 35 U.S.C. 154(b) by 346 days.

(21) Appl. No.: 16/822,232

(22) Filed: Mar. 18, 2020

(65) Prior Publication Data

US 2021/0293508 A1 Sep. 23, 2021

(51) Int. Cl.
*F42B 12/56* (2006.01)
*F41B 6/00* (2006.01)

(52) U.S. Cl.
CPC ..... *F41B 6/00* (2013.01); *F42B 12/56* (2013.01)

(58) Field of Classification Search
CPC ..... F42B 12/56; F42B 12/58; F42B 12/60
See application file for complete search history.

(56) References Cited

U.S. PATENT DOCUMENTS 3,187,236 A * 6/1965 Leslie ..... H01L 39/02 505/879
3,193,734 A * 7/1965 Hempstead ..... H01F 6/00 505/880
3,250,958 A * 5/1966 Rothwarf ..... H01F 6/00 307/106
3,458,763 A * 7/1969 Kunzler ..... H01F 6/02 335/216
3,513,421 A * 5/1970 Drautman ..... H01L 39/20 335/216
4,372,214 A * 2/1983 Toton ..... F42B 1/00 102/305
4,862,021 A * 8/1989 LaRocca ..... F02G 1/0435 310/10
4,901,621 A * 2/1990 Tidman ..... F42B 6/006 89/8
5,301,362 A * 4/1994 Ohkawa ..... G01S 5/04 375/295
9,062,949 B1 6/2015 Clemen, Jr. et al.
2017/0191814 A1* 7/2017 Grace ..... H03K 3/53

* cited by examiner

*Primary Examiner* — Gabriel J. Klein
(74) *Attorney, Agent, or Firm* — McDonnell Boehnen Hulbert & Berghoff LLP

(57) ABSTRACT

In an example, an apparatus includes a cryogenic container configured to store a cryogenic fluid, a superconducting coil disposed within the cryogenic container, and an outer casing surrounding at least a lateral surface area of the cryogenic container. The apparatus is configured such that, while the superconducting coil is carrying a current, is in a superconducting state, and is being cooled by the cryogenic fluid stored in the cryogenic container, an outward magnetic pressure is imposed on the cryogenic container and the outer casing. The cryogenic container and the outer casing are configured to withstand the outward magnetic pressure for at least a predetermined period of time, including while the superconducting coil is being charged to the superconducting state. An occurrence of a trigger event while the outward magnetic pressure is being imposed causes the cryogenic container and the outer casing to expand and burst into radially-dispersed fragments.

20 Claims, 6 Drawing Sheets

APPARATUSES AND METHODS FOR A SUPERCONDUCTING EXPLOSIVE

FIELD

The present disclosure relates generally to an explosive apparatus, and more particularly, to an explosive apparatus driven by superconductivity.

BACKGROUND

Existing non-lethal explosive devices, such as those for commercial use (e.g., controlled demolition) or riot control, are often made with the type of materials (e.g., chemical explosives) and detonate with the type of high velocity explosive forces that make such devices less safe than desired. Further, such devices, including but not limited to those that contain chemical explosives, often carry a risk of exploding at a time later than when an explosion was intended.

What is needed is a safer non-lethal explosive device that provides a reliable explosive effect.

SUMMARY

In an example, an apparatus is described. The apparatus comprises a cryogenic container configured to store a cryogenic fluid. The apparatus also comprises a superconducting coil disposed within the cryogenic container. The apparatus also comprises an outer casing surrounding at least a lateral surface area of the cryogenic container. The apparatus is configured such that, while the superconducting coil is carrying a current, is in a superconducting state, and is being cooled by the cryogenic fluid stored in the cryogenic container, an outward magnetic pressure is imposed on the cryogenic container and the outer casing. The cryogenic container and the outer casing are configured to withstand the outward magnetic pressure for at least a predetermined period of time, including while the superconducting coil is being charged to the superconducting state. An occurrence of a trigger event while the outward magnetic pressure is being imposed on the cryogenic container and the outer casing causes the cryogenic container and the outer casing to expand and burst into radially-dispersed fragments.

In another example, a method is described. The method comprises disposing a superconducting coil within a cryogenic container that is configured to store a cryogenic fluid. The method also comprises enclosing the cryogenic container in an outer casing that surrounds at least a lateral surface area of the cryogenic container. While the superconducting coil is carrying a current, is in a superconducting state, and is being cooled by the cryogenic fluid stored in the cryogenic container, an outward magnetic pressure is imposed on the cryogenic container and the outer casing. The cryogenic container and the outer casing are configured to withstand the outward magnetic pressure for at least a predetermined period of time, including while the superconducting coil is being charged to the superconducting state. An occurrence of a trigger event while the outward magnetic pressure is being imposed on the cryogenic container and the outer casing causes the cryogenic container and the outer casing to expand and burst into radially-dispersed fragments.

In another example, an apparatus is described. The apparatus comprises a cryogenic container configured to store a cryogenic fluid. The apparatus also comprises a superconducting coil disposed within the cryogenic container. The apparatus also comprises an expandable conducting structure attached to the cryogenic container and configured to carry an induced current from the superconducting coil. The apparatus is configured such that, while the superconducting coil is carrying a current, is in a superconducting state, and is being cooled by the cryogenic fluid stored in the cryogenic container, the induced current is established in the expandable conducting structure and an outward magnetic pressure is imposed on the cryogenic container and the expandable conducting structure. The cryogenic container is configured to withstand the outward magnetic pressure for at least a predetermined period of time, including while the superconducting coil is being charged to the superconducting state. An occurrence of a trigger event while the outward magnetic pressure is being imposed on the cryogenic container causes the cryogenic container to expand and burst into radially-dispersed fragments.

The features, functions, and advantages that have been discussed can be achieved independently in various examples or may be combined in yet other examples. Further details of the examples can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Figure 1:
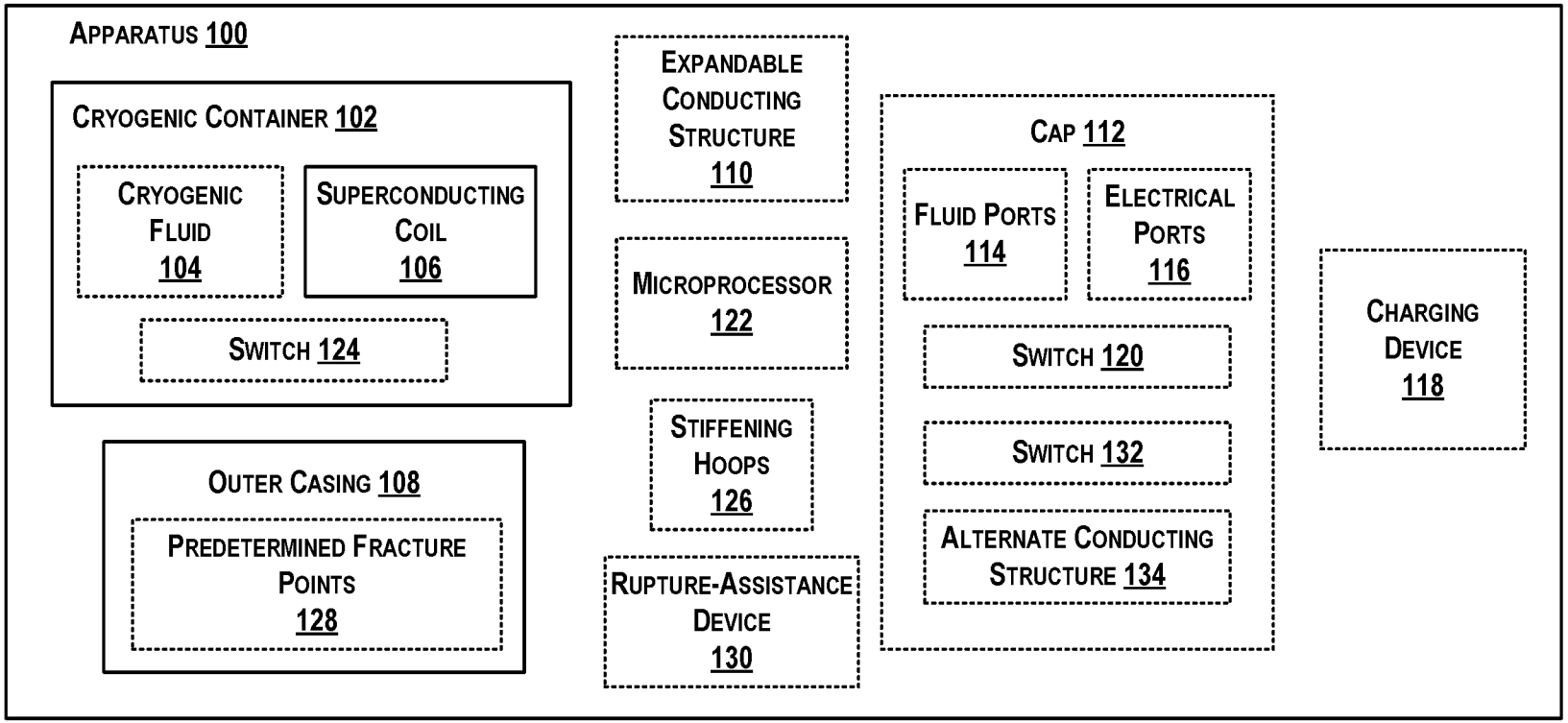
FIG. 1 illustrates an example of an apparatus for a superconducting explosive device, according to an example implementation.

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

By the terms "substantially," "about," "approximately," and "proximate" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Unless otherwise specifically noted, elements depicted in the drawings are not necessarily drawn to scale.

Described herein are apparatuses and methods for a superconducting explosive device, particularly where the high energy density of a superconducting material within such a device is transferred to explosive mechanical energy.

Within examples, apparatuses for a superconducting explosive device include a cryogenic container, a superconducting coil disposed within the cryogenic container, and an outer casing surrounding at least a lateral surface area of the cryogenic container. To prepare such an apparatus for use, cryogenic fluid is inserted into the cryogenic container and the superconducting coil is charged with a current so that the superconducting coil reaches a superconducting state. This causes an outward magnetic pressure to be imposed on the structures surrounding the superconducting coil, including the cryogenic container and the outer casing. In some scenarios, the heat from the superconducting coil can cause the cryogenic fluid to expand and even further increase the pressure on the surrounding structures.

The cryogenic container and the outer casing can be made with high tensile strength materials and/or otherwise be configured to withstand the outward magnetic pressure (and perhaps other pressures that might be present, such as due to the rapid warming and expansion of the cryogenic fluid) for at least a predetermined period of time, including while the superconducting coil is being charged to the superconducting state. This predetermined period of time can be, for example, until or before a trigger event occurs, such as the apparatus colliding with a surface (e.g., after being dropped from a high altitude) or another means of compromising the cryogenic container and outer casing so that they can no longer withstand the pressure within. Upon the occurrence of the trigger event, the outer casing will expand and burst into radially-dispersed fragments.

As will be discussed herein, alternative designs are possible as well, such as those where the cryogenic container is configured to withstand the outward magnetic pressure such that the outer casing can optionally be added for additional strength. Further, at least one of the example apparatuses described herein also include an expandable conducting structure in which a current is induced from the superconducting coil. Thus, if the superconducting coil fails (e.g., breaks), the induced current in the expandable conducting structure can maintain a magnetic field and thus maintain an outward magnetic pressure imposed on the surrounding structures.

Example apparatuses and methods described herein can be designed to be non-lethal and safer than many typical explosive devices, all while providing a reliable explosive effect for various uses, such as commercial uses and riot control. Superconducting materials can give example apparatuses high energy densities for creating a desirable explosive effect. Further, the outer casing and/or the cryogenic container can be made of a material that minimizes damage upon impact, such as rubber. The example apparatuses and methods also do not implement typical explosives, such as chemical explosives, that can be unreliable even when seemingly inert. Example apparatuses are inert until the superconducting coil is charged, and thus the time between when the apparatuses are charged and when the apparatuses are used can be minimized, thereby reducing risk of unintended explosion. For example, the example apparatuses might include a safety valve that can be controlled to release the pressure that builds up inside the apparatuses.

Referring now to the figures, FIG. 1 illustrates an example of an apparatus 100 for a superconducting explosive device, according to an example implementation. The apparatus 100 includes a cryogenic container 102 configured to store a cryogenic fluid 104, a superconducting coil 106 disposed within the cryogenic container 102, and an outer casing 108 surrounding at least a lateral surface area of the cryogenic container 102.

The cryogenic container 102, as noted above, can be configured to store the cryogenic fluid 104, such as liquid nitrogen or liquid helium. The cryogenic container 102 can also be made of one or more high tensile strength materials that can expand and burst, such as a composite (e.g., carbon fiber composite or boron fiber composite), silicone, rubber, strengthening fibers, and/or a plastic substrate, among other possible materials. Further, the cryogenic container 102 acts as a stiffening structure that holds together up to a certain point (e.g., a trigger event that causes the cryogenic container 102 to burst) and can be designed to withstand magnetic pressure for at least approximately a predetermined period of time (e.g., one minute, one hour, etc.) and/or up to approximately a predetermined amount of pressure (e.g., 2 atmospheres, 3 atmospheres, 50,000 atmospheres), including while the superconducting coil 106 is being charged to a superconducting state. The cryogenic container 102 and/or other components of the apparatus 100 discussed herein, such as the outer casing 108, can be cylindrical or have another shape.

The cryogenic fluid 104 can be injected into the cryogenic container 102 when the apparatus 100 is to be used and can take the form liquid nitrogen, liquid helium, or another coolant for the superconducting coil 106 to cool the superconducting coil 106 into a superconducting state.

The superconducting coil 106 can take the form of a copper oxide (e.g., yttrium barium copper oxide) or other material configured to reach a superconducting state at liquid nitrogen temperatures or above, liquid helium temperatures or above, or temperatures of another type of cryogenic fluid or above. In some examples, the superconducting coil 106 can be designed to be highly efficient—that is, designed to carry high currents (e.g., thousands of amperes) while minimizing ohmic losses. Without the use of a superconductor, energy placed into the apparatus 100 might dissipate and the apparatus 100 might become inert before there is a chance to use the apparatus 100. The superconducting coil 106, by contrast, once charged up, enables use of the apparatus 100 for a longer period of time. In alternative examples, superconducting wires, ribbons, or other materials such as a Niobium-Titanium alloy that can reach a superconducting state below temperatures of the cryogenic fluid 104 could be placed inside the cryogenic container 102 and used instead of the superconducting coil 106. Other examples are possible as well.

The outer casing 108, much like the cryogenic container 102, can be comprised of or more high tensile strength materials that can expand and burst, such as a composite (e.g., carbon fiber composite or boron fiber composite), silicone, rubber, strengthening fibers, and/or a plastic substrate, and can be designed to withstand magnetic pressure for at least approximately a predetermined period of time and/or up to approximately a predetermined amount of pressure, including while the superconducting coil 106 is being charged to a superconducting state. As noted above, the outer casing 108 can surround at least a lateral surface area of the cryogenic container 102. For example, if the cryogenic container 102 is cylindrical, the outer casing 108 can surround an area of all sides of the cylinder excluding the base and top of the cylinder. Further, the outer casing 108 can be attached (e.g., adhered, fastened, etc.) to the cryogenic container 102 and/or can surround the cryogenic container 102 in a manner that does not involve a physical coupling between the cryogenic container 102 and the outer casing 108.

In operation, the cryogenic fluid 104 is injected into the cryogenic container 102 and the superconducting coil 106 is charged. While the superconducting coil 106 is carrying a current, is in a superconducting state, and is being cooled by the cryogenic fluid 104 stored in the cryogenic container 102, an outward magnetic pressure is imposed on the cryogenic container 102 and, in turn, on the outer casing 108. While the outward magnetic pressure is being imposed on the cryogenic container 102, an occurrence of a trigger event (e.g., collision with a surface, such as due to the apparatus 100 being dropped from a high altitude) can cause the cryogenic container 102 to expand and burst, thus causing the outer casing 108 to expand and burst into radially-dispersed fragments. In some examples, the amount of outward magnetic pressure can cause the fragments to travel at a velocity up to 2000 meters per second. The apparatus 100 can be designed to burst into fragments that are dispersed symmetrically or non-symmetrically.

Within examples, to prepare the apparatus 100 for use, the cryogenic fluid 104 can be inserted into the cryogenic container 102 and the superconducting coil 106 can be charged. As noted above, the superconducting coil 106 can be charged until a predetermined pressure is reached inside the apparatus 100, such as 2 atmospheres, 3 atmospheres, or even up to 50,000 atmospheres, depending on the size of the apparatus 100, the intended use of the apparatus 100, among other possible criteria. As further noted above, the superconducting coil 106 can additionally or alternatively be charged for a predetermined period of time, one minute, five minutes, one hour, or another period of time. As a general matter, the predetermined period of time can depend in some scenarios on the size of the power supply (e.g., a weaker power supply will take longer). Within examples, a processor, computing device associated with the apparatus 100 (e.g., microprocessor 122), and/or other components (e.g., a pressure sensor), either included as part of the apparatus 100 or remote from the apparatus 100, can be configured (e.g., programmed) to oversee the charging and discharging of the apparatus 100, such as on a predetermined schedule, and/or monitor various parameters associated with the apparatus 100, such as a temperature and/or pressure within the apparatus 100. Thus, it can be determined when the apparatus 100 is ready for use, safe for use, and/or safe to handle when not in use.

Other implementations of the apparatus 100 can include one or more other components as well. Within examples, the apparatus 100 can include an expandable conducting structure 110 attached to the cryogenic container 102. The expandable conducting structure 110 can take the form of one or more wires (e.g., aluminum wires), one or more foils (e.g., aluminum foils), and/or one or more coils, among other possible structures. The expandable conducting structure 110 can be attached to the cryogenic container 102 in various ways, such as by being attached within an interior space defined by the cryogenic container 102 to an interior surface of the cryogenic container 102 (e.g., a conducting metal foil liner), by being embedded within an outer wall of the cryogenic container 102 (e.g., the cryogenic container 102 being made of carbon-loaded silicone and/or having a coil or foil embedded within the outer wall and wrapped around a circumference of the cryogenic container 102), and/or by being attached to an exterior surface of the cryogenic container 102 (e.g., a liner on the outside of the cryogenic container 102) such that the expandable conducting structure 110 is positioned between the exterior surface of the cryogenic container 102 and the outer casing 108. In additional or alternative embodiments, the expandable conducting structure 110 can be attached to, or embedded within, the outer casing 108.

In operation, the changing magnetic field created by the current in the superconducting coil 106 can induce a current in the expandable conducting structure 110. The induced current in the expandable conducting structure 110, additionally or alternatively to the current carried in the superconducting coil 106 itself, can cause the outward magnetic pressure to be imposed on at least the outer casing 108 (and perhaps on the cryogenic container 102, depending on the positioning of the expandable conducting structure 110 relative to the cryogenic container 102). For example, if the superconducting coil 106 is shorted, breaks (e.g., is turned into plasma due to heat), or otherwise loses its charge, the induced current in the expandable conducting structure 110 can advantageously maintain the outward magnetic pressure on the outer casing 108 until the trigger event occurs.

In further examples, the apparatus 100 can include a cap 112 configured to attach to an end of the cryogenic container 102. The cap 112 can include fluid ports 114 via which the cryogenic fluid 104 is inserted into the cryogenic container 102 and can also include electrical ports 116 to which the superconducting coil 106 is connected and via which the current is established in the superconducting coil 106. In such examples, the apparatus 100 can also include a charging device 118 configured to supply current via the electrical ports 116 to the superconducting coil 106. The charging device 118 can take the form of a portable or non-portable power source configured to provide current. In some embodiments, the charging device 118 can be integrated with the cap 112 such that the cap 112 can be used to charge the superconducting coil 106 when attached to the end of the cryogenic container 102. In alternative embodiments, the charging device 118 can be physically separate from the cap 112 and removably attached to the cap 112. As such, the electrical ports 116 can be connected to the superconducting coil 106 and, when the apparatus 100 is ready to be charged (e.g., when the apparatus 100 is loaded onto a vehicle configured to deploy the apparatus 100 for explosion), the charging device 118 can be connected to the cap 112, used to charge the superconducting coil 106, and then removed.

In some embodiments, the cap 112 can be removably attached to the cryogenic container 102 such that, once the cryogenic fluid 104 has been inserted and the superconducting coil 106 has been charged, the cap 112 can be removed before the apparatus 100 is used. Alternatively, the cap 112 can be affixed to the cryogenic container 102 and remain affixed to the cryogenic container 102 during deployment of the apparatus 100.

In examples where the apparatus 100 includes the cap 112, the cap 112 can include a switch 120 and the apparatus 100 can include a microprocessor 122. The switch 120 can take various forms, such as that of a rectifier, junction switch, or diode. In some examples, the switch 120 can be a superconducting switch. The microprocessor 122 can be a general-purpose processor or special purpose processor (e.g., a digital signal processor, application specific integrated circuit, etc.) configured to execute instructions (e.g., computer-readable program instructions including computer executable code) to provide various operations. For example, the microprocessor 122 can be programmed to detect that the charging device 118 has stopped supplying the current to the superconducting coil 106 and, in response to detecting that the charging device 118 has stopped supplying the current, control the switch 120 to electrically connect ends of the superconducting coil 106 to each other, so as to enable continued flow of the current through the superconducting coil 106 and thus maintain the magnetic field density in the apparatus 100 until the apparatus 100 is ready to be used (e.g., ready to be dropped or ready to have the trigger event initiated in some other way). The microprocessor 122 might also responsively control the fluid ports 114 to close. Additionally or alternatively to using the microprocessor 122, the switch 120 can be mechanically configured such that the act of detaching the charging device 118 from the cap 112 can cause the switch 120 to electrically connect the ends of the superconducting coil 106 to each other and/or close the fluid ports 114. To facilitate this, the switch 120 can be mechanically coupled to the electrical ports 116 and/or the fluid ports 114.

In some implementations, the cap 112 can be designed to act as a cap that can attach to multiple apparatuses at once. Similarly, the charging device 118 can be designed to act as a charging device that can connect to and charge multiple apparatuses at once. As such, such apparatuses can be filled with cryogenic fluid, charged, and made ready for use in less time.

In alternative examples, the microprocessor 122 (or other type of processor) can be remote from the apparatus 100 and can take the form of a processor of a computing device, such as a control system of an aircraft. Such a processor can also be configured to execute instructions that cause one or more operations to occur, such as initiating and stopping charging of the superconducting coil 106, removal of the cap 112, initiating and stopping insertion of the cryogenic fluid 104 into the cryogenic container 102, deploying the apparatus 100, and/or initiating the trigger event, among other possibilities.

In further examples, additionally or alternatively to the switch 120 being in the cap 112, the apparatus 100 can include a switch 124 can be disposed within the cryogenic container 102 and mechanically configured such that detachment of the cap 112 from the cryogenic container 102 causes the switch 124 to electrically connect ends of the superconducting coil 106 to each other, so as to enable continued flow of the current through the superconducting coil 106 and thus maintain the magnetic field density in the apparatus 100 until the apparatus 100 is ready to be used. Switch 124 can take various forms, such as that of a rectifier, junction switch, or diode. In some examples, the switch 124 can be a superconducting switch. Further, the switch 124 can be mechanically configured such that the act of detaching the charging device 118 from the cap 112 can cause the switch 124 to electrically connect the ends of the superconducting coil 106 to each other and/or close the fluid ports 114. To facilitate this, the switch 124 can be mechanically coupled to the electrical ports 116 and/or the fluid ports 114.

In further examples, the apparatus 100 can include a plurality of stiffening hoops 126 wrapped around an exterior surface of the outer casing 108, so as to provide additional support in withstanding the outward magnetic pressure being imposed on the cryogenic container 102 and the outer casing 108—that is, until the trigger event occurs, in which case the plurality of stiffening hoops 126 can burst as well. To facilitate this, the plurality of stiffening hoops 126 can be made of a conducting material such as metal, a non-conducting material such as fiberglass or S-glass, or a weaker conducting material such as carbon fiber or boron fiber materials. Additionally or alternatively, other structures, annular or not annular, can be used to help withstand the outward magnetic pressure.

To assist with triggering explosion of the apparatus 100, the outer casing 108 can include predetermined fracture points 128, in some examples. The predetermined fracture points 128 can take the form of deliberately-placed weak points in the outer casing 108 so that the outer casing 108 will burst in a particular way. For example, the predetermined fracture points 128 can be positioned so as to segment the outer casing 108 such that the outer casing 108 will burst into radially-dispersed fragments having predetermined dimensions. Alternatively, the predetermined fracture points 128 can be positioned so as to help cause at least one fragment of the outer casing 108 to travel in a particular direction upon explosion. For instance, the outer casing 108 might not include fracture points anywhere except specific fragments on a left and right side of the apparatus 100, so that such fragments are directed with a trajectory in the left and right directions. In additional examples, the cryogenic container 102 can be designed to include fracture points as well, at least some of which might correspond to the locations of the predetermined fracture points 128.

In operation, explosion of the apparatus 100 can be initiated in various ways. For example, the apparatus 100 can collide with a surface (e.g., after being released from an aircraft), thereby compromising the tensile strength of the outer casing 108, the cryogenic container 102, and other possible structures (e.g., the plurality of stiffening hoops 126) that are holding back the outward magnetic pressure. As another example, explosion can be initiated by superconducting quench—namely, when the limits of the superconducting coil 106 are exceeded so that the superconducting coil 106 becomes normal conducting. In this scenario, the cryogenic fluid 104 can transition from liquid to gas and expand due to the heat from the superconducting coil 106, thereby imposing additional pressure on the surrounding structures to the point that the apparatus 100 will explode. As such, the cryogenic fluid 104 can helpfully enhance the blast from the apparatus 100.

Additionally or alternatively to the examples provided above, the apparatus 100 can include a rupture-assistance device 130 that, when activated, can initiate explosion of the apparatus 100, in which case the trigger event can involve activation of the rupture-assistance device 130. For example, the rupture-assistance device 130 can take the form of at least one bridge wire (e.g., a metal bridge wire), carbon fiber, and/or boron fiber attached to the outer casing 108 (e.g., attached to an exterior of the outer casing 108 or embedded at least partially within the outer casing 108), the cryogenic container 102, and/or the plurality of stiffening hoops 126. Thus, a power supply can be used to supply enough current through the bridge wire(s) and/or fiber(s) to trigger an explosion of the bridge wire(s) and/or fiber(s), thereby compromising the outer casing 108 and initiating explosion of the apparatus 100. As another example, the rupture-assistance device 130 can be at least one bridge wire attached to the superconducting coil 106. As such, current can be supplied through the bridge wire(s), thus heating the superconducting coil 106 until the superconducting coil 106 breaks, which can in turn lead to rapid heating and liquid-to-gas transition of the cryogenic fluid 104, rapid pressure rise in the cryogenic container 102, and bursting of the apparatus 100.

As a further example, the rupture-assistance device 130 can take the form of a pyrotechnic or otherwise explosive fastener used to attach the outer casing 108 to the cryogenic container 102 or otherwise attached to the outer casing 108 and/or the cryogenic container 102. Such a fastener can be made of thermite-based material or another explosive material, and the explosion of the fastener can be triggered by supplying current to the fastener. As yet another example, a shape memory alloy fastener or other structure can be included in the outer casing 108 such that, when the shape memory alloy is heated to a certain degree, the shape memory alloy will change shape in a way that compromises the integrity of the outer casing 108. Other examples are possible as well.

Furthermore, because the superconducting coil 106 must be charged for the apparatus 100 to be able to explode, the apparatus 100 can be inert when unpowered. Within examples, the apparatus 100 can be made inert by the use of a safety valve (not shown) that can be activated/deactivated manually or automatically (e.g., via machinery and/or electronics controlled by a processor, such as microprocessor 122) to release the pressure of the cryogenic fluid 104 once the cryogenic fluid 104 becomes heated and turns to a gas. For instance, a processor can determine that the apparatus 100 has not burst within a predetermined period of time (e.g., within five minutes since deployment, within two hours since charging began, etc.) and responsively operate the safety valve to release the pressure. Within other examples, the microprocessor 122 or other processor or computing device can be programmed to detect that the predetermined period of time has expired and, in response to detecting that the predetermined period of time has expired, control a switch 132 to electrically connect the superconducting coil 106 and/or the expandable conducting structure 110 to the alternate conducting structure 134, so as to cause the current to instead follow the alternate current path, thereby burning down the stored energy in the apparatus 100 so that the apparatus 100 will be less likely to burst. In some embodiments, such a switch 132 and the alternate conducting structure 134 could be located in the cap 112 (as shown in FIG. 1), in the cryogenic container 102, or elsewhere in the apparatus 100. The alternate conducting structure 134 can take the form of one or more wires or other structures made of conducting materials such as metal.

Figure 2:
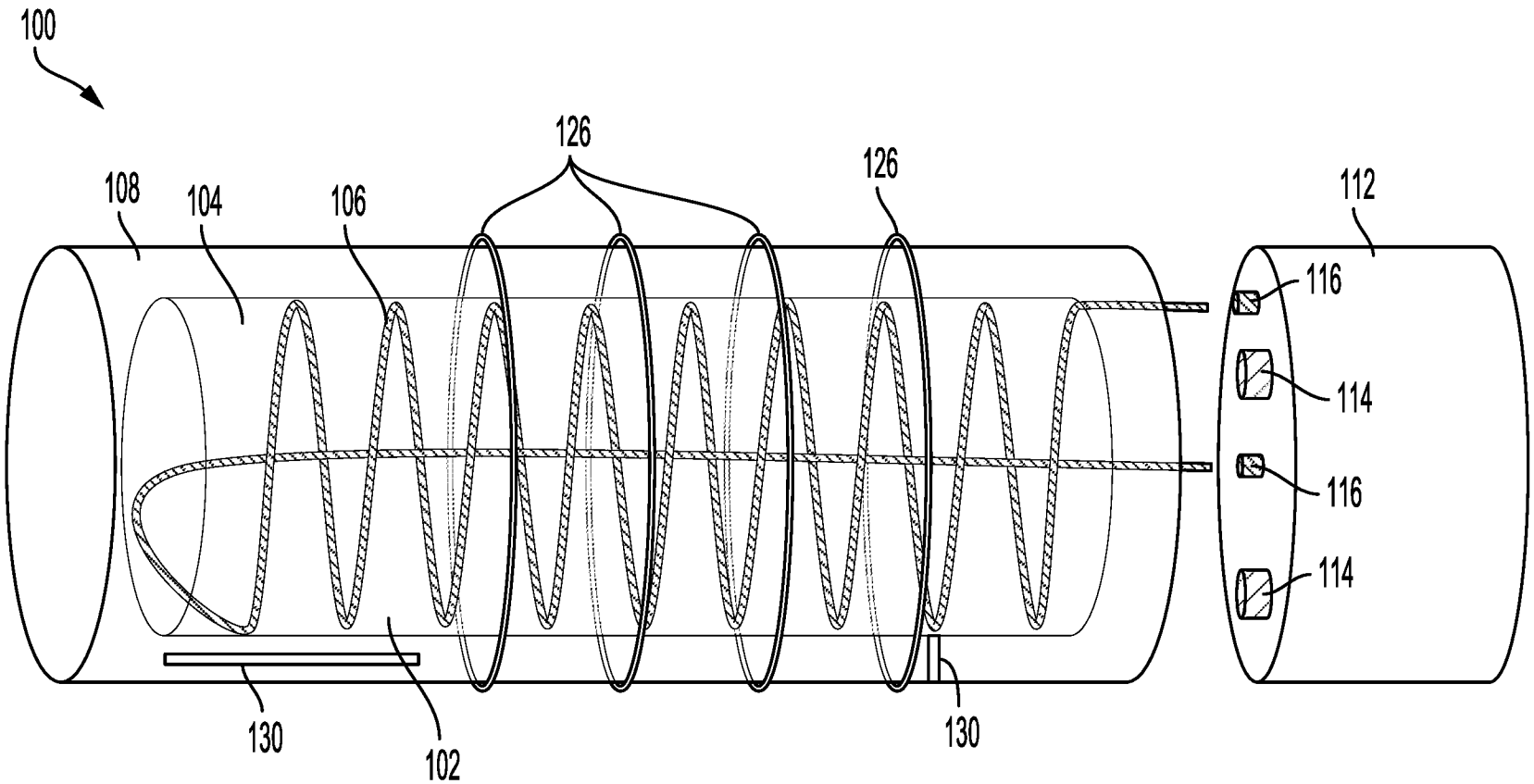
FIG. 2 illustrates a perspective side view of the apparatus of FIG. 1, according to an example implementation.
Figure 5:
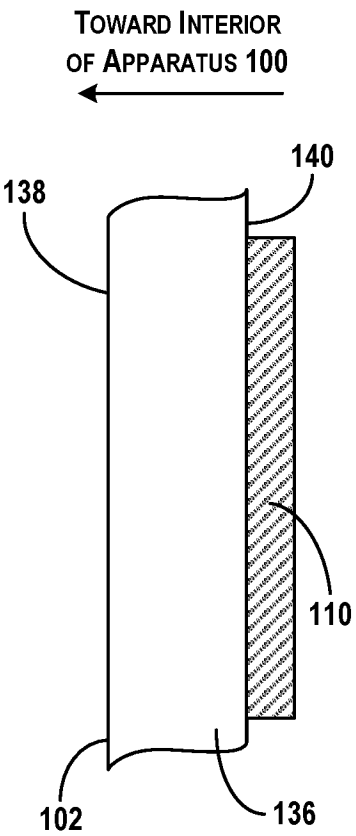
FIG. 5 illustrates another cross-sectional side view of a portion of the outer wall of the cryogenic container of FIG. 1, according to an example implementation.
Figure 4:
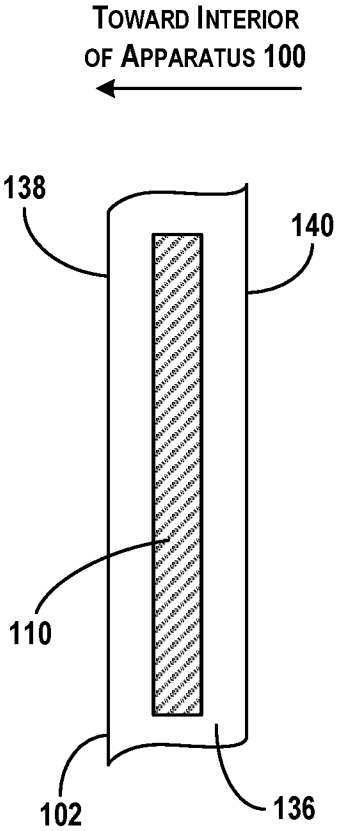
FIG. 4 illustrates another cross-sectional side view of a portion of the outer wall of the cryogenic container of FIG. 1, according to an example implementation.
Figure 3:
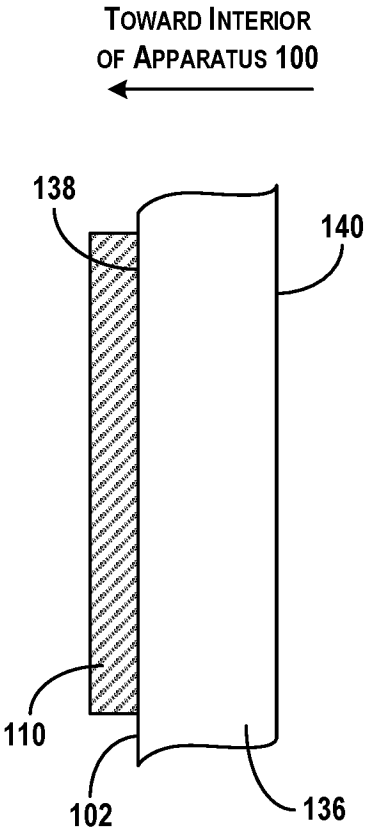
FIG. 3 illustrates a cross-sectional side view of a portion of an outer wall of the cryogenic container of FIG. 1, according to an example implementation.

FIG. 2 illustrates a perspective side view of the apparatus 100, according to an example implementation. As shown, the apparatus 100 includes the cryogenic container 102, cryogenic fluid 104, the superconducting coil 106, the outer casing 108, the cap 112, the fluid ports 114, the electrical ports 116, the plurality of stiffening hoops 126, and two examples of the rupture-assistance device 130, one attached to the outer casing 108 and one attached to the superconducting coil 106. Although the expandable conducting structure 110 is not shown in FIG. 2, one could be included in some implementations. FIGS. 3-5 illustrates example ways in which the expandable conducting structure 110 can be attached to the cryogenic container 102.

FIG. 3 illustrates a cross-sectional side view of a portion of an outer wall 136 of the cryogenic container 102 that defines the space within which the superconducting coil (not shown) resides, according to an example implementation. In particular, the outer wall 136 has an interior surface 138 and an exterior surface 140. As shown, the expandable conducting structure 110 is attached to the interior surface 138.

FIG. 4 illustrates another cross-sectional side view of a portion of the outer wall 136 of the cryogenic container 102, according to an example implementation. As shown, the expandable conducting structure 110 is embedded within the outer wall 136.

FIG. 5 illustrates another cross-sectional side view of a portion of the outer wall 136 of the cryogenic container 102, according to an example implementation. As shown, the expandable conducting structure 110 is attached to the exterior surface 140, and thus might be adjacent to, or partially embedded in, the outer casing 108, which is not shown in FIG. 5.

Figure 6:
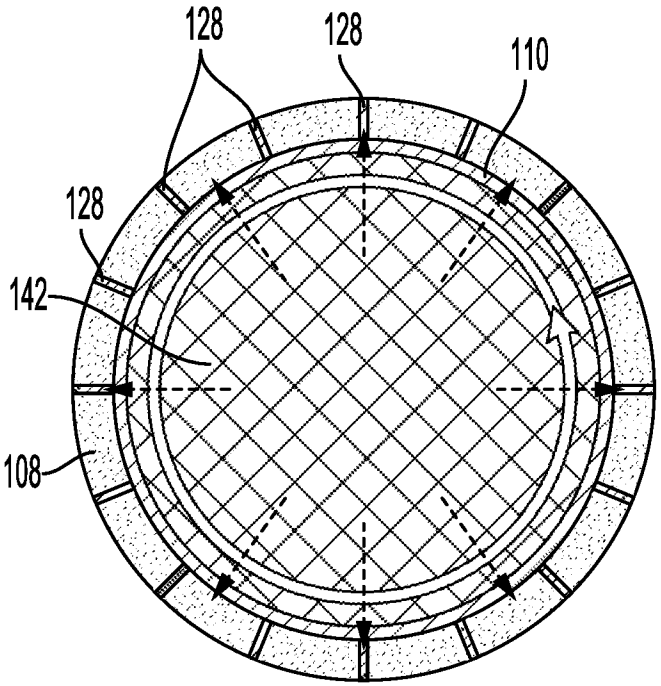
FIG. 6 illustrates an outward magnetic pressure being imposed on the outer casing of the apparatus of FIG. 1, according to an example implementation.

FIG. 6 illustrates an outward magnetic pressure (designated by dotted arrows pointing radially outward) being imposed on the outer casing 108 of the apparatus 100, according to an example implementation. Further, FIG. 6 shows the expandable conducting structure 110 and a representative example of the predetermined fracture points 128. For simplicity, the cryogenic container 102 is not shown. In addition, the solid circular arrow represents current flow, such as current flowing in the superconducting coil 106 (not shown) or the induced current in the expandable conducting structure 110. A patterned region 142 is shown as well, which represents the magnetic field within the apparatus 100 that creates the outward magnetic pressure.

Figure 7:
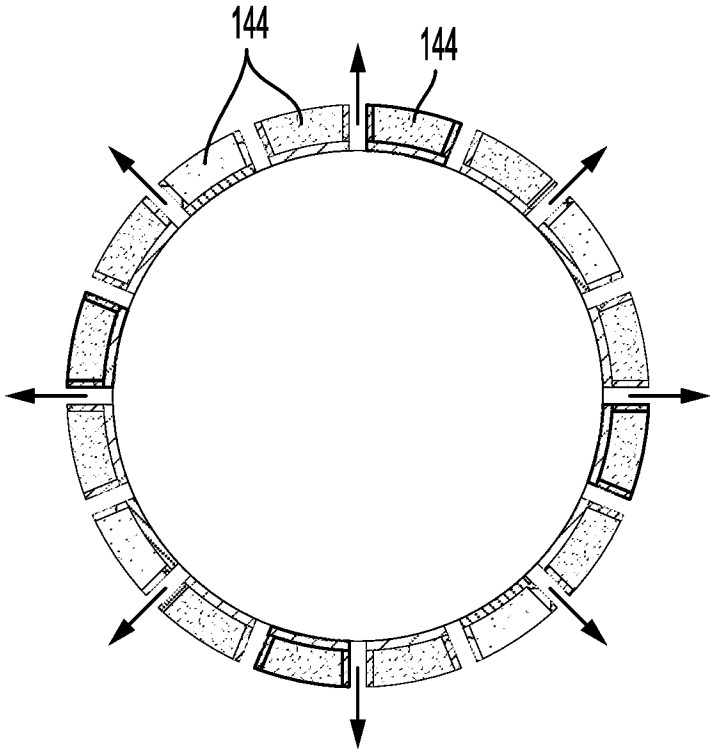
FIG. 7 illustrates the outer casing and the expandable conducting structure of the apparatus of FIG. 1 bursting into radially-dispersed fragments, according to an example implementation.

FIG. 7 illustrates the outer casing 108 and expandable conducting structure 110 bursting into radially-dispersed fragments 144, according to an example implementation. Although the cryogenic container 102 is not shown, it might burst into similar fragments as well.

Figure 8:
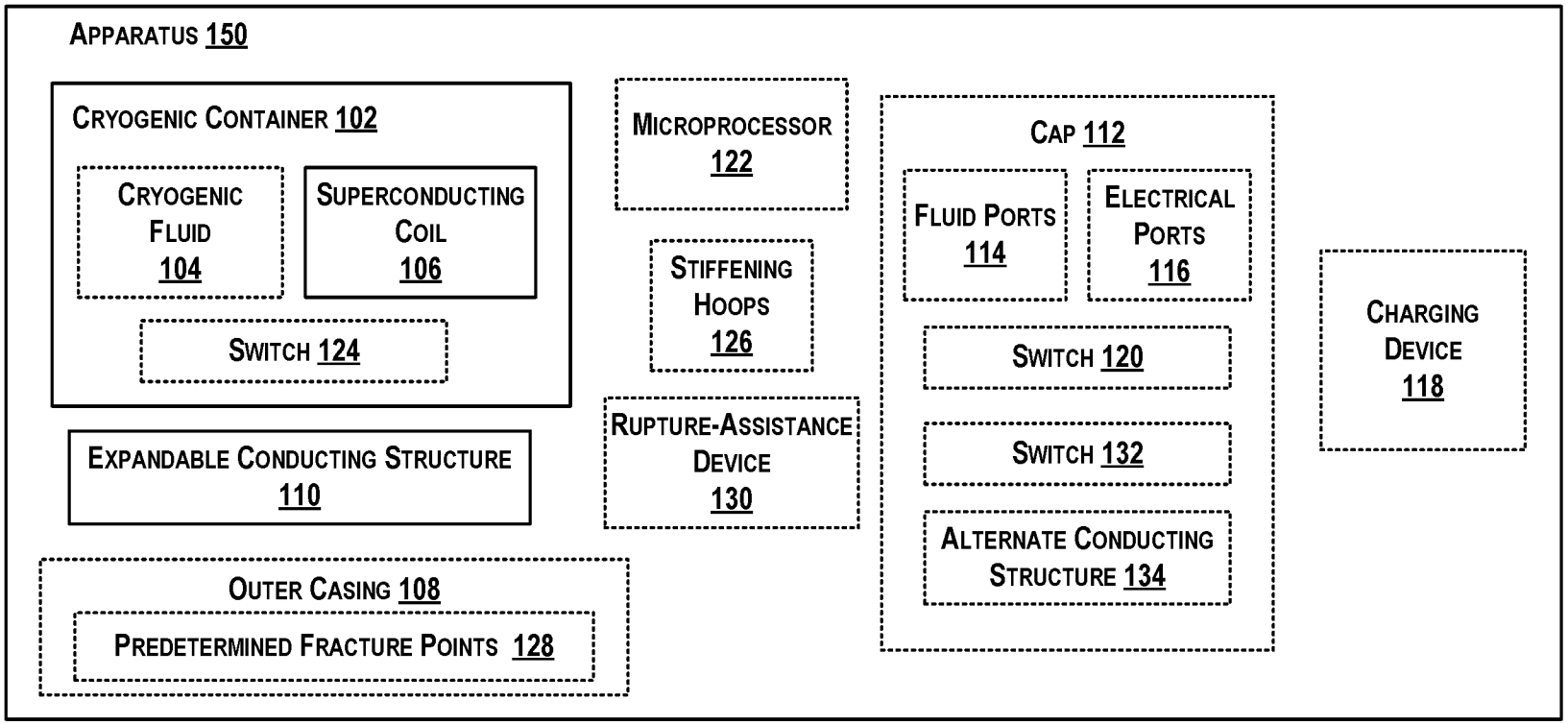
FIG. 8 illustrates an example of a second apparatus for a superconducting explosive device, according to an example implementation.

FIG. 8 illustrates an example of a second apparatus 150 for a superconducting explosive device, according to an example implementation. The second apparatus 150 can be used as an alternative design to the apparatus 100 illustrated in FIG. 1. As shown, the second apparatus 150 includes the cryogenic container 102 configured to store the cryogenic fluid 104, the superconducting coil 106 disposed within the cryogenic container 102, and an expandable conducting structure 110 attached to the cryogenic container 102 and configured to carry an induced current from the superconducting coil 106. The components shown in FIG. 8 in dotted blocks represent components that can be optionally included and/or used with the second apparatus 150 in much the same way as described above with respect to the apparatus 100 of FIG. 1.

The second apparatus 150 represents a superconducting explosive device where the cryogenic container 102 itself can serve a similar purpose to the outer casing 108, and thus, the outer casing 108 can be optional. However, in some implementations, the outer casing 108 can be included as well.

Similar to the apparatus 100 of FIG. 1, the second apparatus 150 is configured such that, while the superconducting coil 106 is carrying a current, is in a superconducting state, and is being cooled by the cryogenic fluid 104 stored in the cryogenic container 102, the induced current is established in the expandable conducting structure 110 and an outward magnetic pressure is imposed on the cryogenic container 102 and the expandable conducting structure 110. The cryogenic container 102 is configured to withstand the outward magnetic pressure for at least a predetermined period of time, including while the superconducting coil 106 is being charged to the superconducting state. Furthermore, an occurrence of a trigger event (e.g., collision with a surface, activation of a rupture-assistance device 130, etc.) while the outward magnetic pressure is being imposed on the cryogenic container 102 will compromise the tensile strength of the cryogenic container 102, thus causing the cryogenic container 102 to expand and burst into radially-dispersed fragments.

Figure 9:
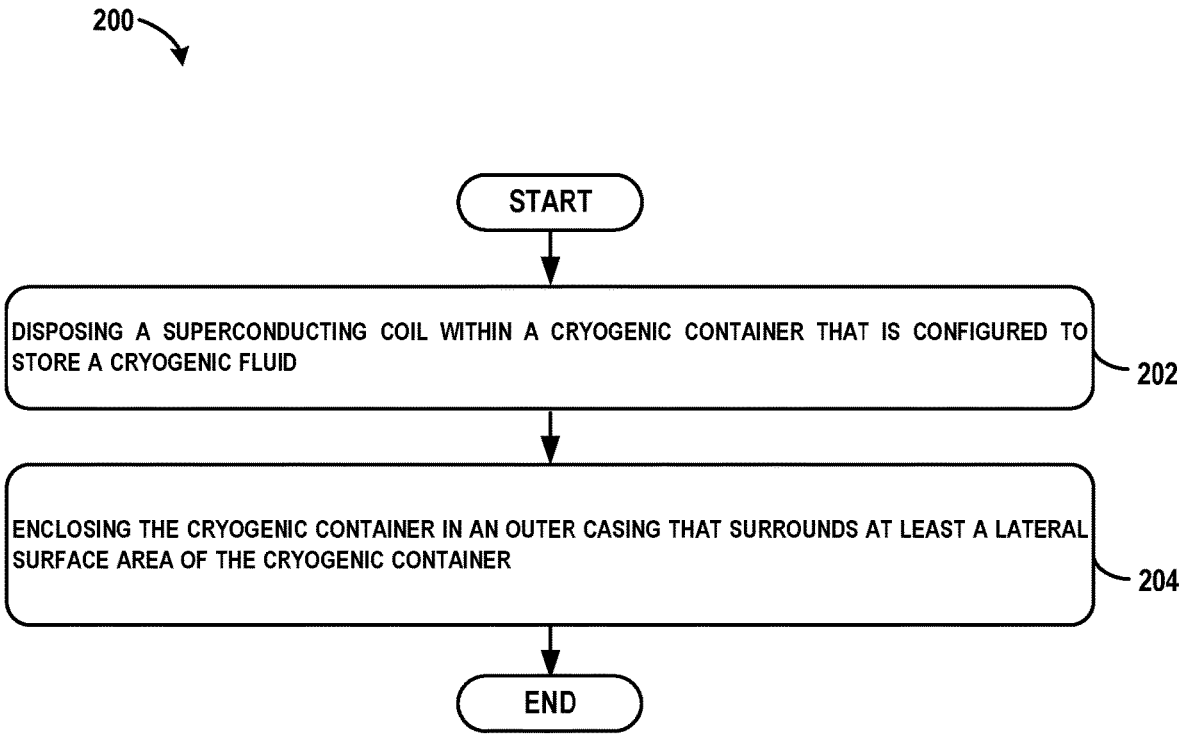
FIG. 9 shows a flowchart of an example method, according to an example implementation.

FIG. 9 shows a flowchart of an example of a method 200 that could be used in manufacturing the apparatus 100 shown in FIG. 1. Method 200 may include one or more operations, functions, or actions as illustrated by one or more of blocks 202-204.

At block 202, the method 200 includes disposing a superconducting coil within a cryogenic container that is configured to store a cryogenic fluid.

At block 204, the method 200 includes enclosing the cryogenic container in an outer casing that surrounds at least a lateral surface area of the cryogenic container.

In operation and in accordance with the method 200, while the superconducting coil is carrying a current, is in a superconducting state, and is being cooled by the cryogenic fluid stored in the cryogenic container, an outward magnetic pressure is imposed on the cryogenic container and the outer casing. In addition, the cryogenic container and the outer casing are configured to withstand the outward magnetic pressure for at least a predetermined period of time, including while the superconducting coil is being charged to the superconducting state, and an occurrence of a trigger event while the outward magnetic pressure is being imposed on the cryogenic container and the outer casing causes the cryogenic container and the outer casing to expand and burst into radially-dispersed fragments.

In some examples, the method 200 can include attaching an expandable conducting structure to the cryogenic container. In such examples, the expandable conducting structure is configured to carry an induced current from the superconducting coil. The induced current causes the outward magnetic pressure to be imposed on at least the outer casing. The act of attaching the expandable conducting structure can involve attaching the expandable conducting structure to an interior surface of the cryogenic container, embedding the expandable conducting structure within an outer wall of the cryogenic container, and/or attaching the expandable conducting structure to an exterior surface of the cryogenic container.

In some examples, the method 200 can include attaching a cap to an end of the cryogenic container, where the cap comprises fluid ports via which the cryogenic fluid is inserted into the cryogenic container, and electrical ports via which the current is established in the superconducting coil. In such examples, the act of attaching the cap to the end of the cryogenic container involves attaching the electrical ports to ends of the superconducting coil.

As discussed above, an alternative apparatus to apparatus 100, such as apparatus 150, can include a cryogenic container, a superconducting coil, and an expandable conducting structure, and perhaps optionally including an outer casing and/or a cap. Accordingly, a method for manufacturing apparatus 150 can involve disposing a superconducting coil within a cryogenic container configured to store a cryogenic fluid, and the method can also involve attaching an expandable conducting structure to the cryogenic container, where the expandable conducting structure is configured to carry an induced current from the superconducting coil.

In operation and in accordance with this method for manufacturing apparatus 150, while the superconducting coil is carrying a current, is in a superconducting state, and is being cooled by the cryogenic fluid stored in the cryogenic container, the induced current is established in the expandable conducting structure and an outward magnetic pressure is imposed on the cryogenic container and the expandable conducting structure. In addition, the cryogenic container is configured to withstand the outward magnetic pressure for at least a predetermined period of time, including while the superconducting coil is being charged to the superconducting state. And an occurrence of a trigger event while the outward magnetic pressure is being imposed on the cryogenic container causes the cryogenic container to expand and burst into radially-dispersed fragments.

Devices or systems may be used or configured to perform logical functions presented in FIG. 9. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner. Although blocks in FIG. 9, are illustrated in a sequential order, these blocks may also be performed in parallel, and/or in a different order than those described herein. Also, the various blocks may be combined into fewer blocks, divided into additional blocks, and/or removed based upon the desired implementation.

It should be understood that for these and other processes and methods disclosed herein, flowcharts show functionality and operation of one possible implementation of present examples. In this regard, each block or portions of each block may represent a module, a segment, or a portion of program code, which includes one or more instructions executable by a processor for implementing specific logical functions or steps in the process. The program code may be stored on any type of computer readable medium or data storage, for example, such as a storage device including a disk or hard drive. Further, the program code can be encoded on a computer-readable storage media in a machine-readable format, or on other non-transitory media or articles of manufacture. The computer readable medium may include non-transitory computer readable medium or memory, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a tangible computer readable storage medium, for example.

In addition, each block or portions of each block in FIG. 9 may represent circuitry that is wired to perform the specific logical functions in the process. Alternative implementations are included within the scope of the examples of the present disclosure in which functions may be executed out of order from that shown or discussed, including substantially concurrent or in reverse order, depending on the functionality involved, as would be understood by those reasonably skilled in the art.

Different examples of the system(s), device(s), and method(s) disclosed herein include a variety of components, features, and functionalities. It should be understood that the various examples of the system(s), device(s), and method(s)

disclosed herein may include any of the components, features, and functionalities of any of the other examples of the system(s), device(s), and method(s) disclosed herein in any combination or any sub-combination, and all of such possibilities are intended to be within the scope of the disclosure.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. An apparatus comprising:

a cryogenic container configured to store a cryogenic fluid;

a superconducting coil disposed within the cryogenic container; and an outer casing surrounding at least a lateral surface area of the cryogenic container, wherein the apparatus is configured such that, while the superconducting coil is carrying a current, is in a superconducting state, and is being cooled by the cryogenic fluid stored in the cryogenic container, an outward magnetic pressure is imposed on the cryogenic container and the outer casing, wherein the cryogenic container and the outer casing are configured to withstand the outward magnetic pressure for at least a predetermined period of time, including while the superconducting coil is being charged to the superconducting state, and wherein an occurrence of a trigger event while the outward magnetic pressure is being imposed on the cryogenic container and the outer casing causes the cryogenic container and the outer casing to expand and burst into radially-dispersed fragments.

2. The apparatus of claim 1, further comprising:

an expandable conducting structure attached to the cryogenic container and configured to carry an induced current from the superconducting coil, wherein the induced current causes the outward magnetic pressure to be imposed on at least the outer casing.

3. The apparatus of claim 2, wherein the expandable conducting structure comprises one or more of foil, wires, or a coil.

4. The apparatus of claim 2, wherein the expandable conducting structure is attached to the cryogenic container by being one or more of: attached to an interior surface of the cryogenic container, embedded within an outer wall of the cryogenic container, or attached to an exterior surface of the cryogenic container.

5. The apparatus of claim 1, further comprising:

a cap configured to attach to an end of the cryogenic container, the cap comprising:

fluid ports via which the cryogenic fluid is inserted into the cryogenic container, and electrical ports to which the superconducting coil is connected and via which the current is established in the superconducting coil; and a charging device configured to supply current via the electrical ports to the superconducting coil.

6. The apparatus of claim 5, wherein the charging device is integrated with the cap.

7. The apparatus of claim 5, wherein the charging device is removably attached to the cap.

8. The apparatus of claim 5, wherein the cap further comprises a switch, and wherein the apparatus further comprises a microprocessor programmed to detect that the charging device has stopped supplying the current and, in response to detecting that the charging device has stopped supplying the current, control the switch to electrically connect ends of the superconducting coil to each other, so as to enable continued flow of the current through the superconducting coil.

9. The apparatus of claim 5, further comprising a switch disposed within the cryogenic container and mechanically configured such that detachment of the cap from the cryogenic container causes the switch to electrically connect ends of the superconducting coil to each other, so as to enable continued flow of the current through the superconducting coil.

10. The apparatus of claim 5, wherein the cap further comprises:

a switch; and an alternate conducting structure coupled to the switch and defining an alternate current path, wherein the apparatus further comprises a microprocessor programmed to detect that a predetermined period of time has expired and, in response to detecting that the predetermined period of time has expired, control the switch to electrically connect the superconducting coil to the alternate conducting structure, so as to cause the current to instead follow the alternate current path.

11. The apparatus of claim 1, further comprising a plurality of stiffening hoops wrapped around an exterior surface of the outer casing, so as to provide additional support in withstanding the outward magnetic pressure being imposed on the cryogenic container and the outer casing.

12. The apparatus of claim 1, wherein the outer casing comprises predetermined fracture points, wherein the occurrence of the trigger event while the outward magnetic pressure is being imposed on the cryogenic container and the outer casing causes the cryogenic container and the outer casing to expand and burst at the predetermined fracture points into the radially-dispersed fragments.

13. The apparatus of claim 1, further comprising a rupture-assistance device, wherein the trigger event comprises activation of the rupture-assistance device.

14. The apparatus of claim 13, wherein the rupture-assistance device comprises at least one bridge wire attached to the outer casing, and wherein the activation of the rupture-assistance device comprises supplying current through the at least one bridge wire.

15. The apparatus of claim 13, wherein the rupture-assistance device comprises at least one bridge wire attached to the superconducting coil, and wherein the activation of the rupture-assistance device comprises supplying current through the at least one bridge wire, so as to heat and break the superconducting coil.

16. A method comprising:

disposing a superconducting coil within a cryogenic container that is configured to store a cryogenic fluid; and enclosing the cryogenic container in an outer casing that surrounds at least a lateral surface area of the cryogenic container, wherein, while the superconducting coil is carrying a current, is in a superconducting state, and is being cooled by the cryogenic fluid stored in the cryogenic container, an outward magnetic pressure is imposed on the cryogenic container and the outer casing, wherein the cryogenic container and the outer casing are configured to withstand the outward magnetic pressure for at least a predetermined period of time, including while the superconducting coil is being charged to the superconducting state, and wherein an occurrence of a trigger event while the outward magnetic pressure is being imposed on the cryogenic container and the outer casing causes the cryogenic container and the outer casing to expand and burst into radially-dispersed fragments.

17. The method of claim 16, further comprising:

attaching an expandable conducting structure to the cryogenic container, wherein the expandable conducting structure is configured to carry an induced current from the superconducting coil, and wherein the induced current causes the outward magnetic pressure to be imposed on at least the outer casing.

18. The method of claim 16, further comprising:

attaching a cap to an end of the cryogenic container, wherein the cap comprises fluid ports via which the cryogenic fluid is inserted into the cryogenic container, and electrical ports via which the current is established in the superconducting coil, and wherein attaching the cap to the end of the cryogenic container comprises attaching the electrical ports to ends of the superconducting coil.

19. An apparatus comprising:

a cryogenic container configured to store a cryogenic fluid;

a superconducting coil disposed within the cryogenic container; and an expandable conducting structure attached to the cryogenic container and configured to carry an induced current from the superconducting coil, wherein the apparatus is configured such that, while the superconducting coil is carrying a current, is in a superconducting state, and is being cooled by the cryogenic fluid stored in the cryogenic container, the induced current is established in the expandable conducting structure and an outward magnetic pressure is imposed on the cryogenic container and the expandable conducting structure, wherein the cryogenic container is configured to withstand the outward magnetic pressure for at least a predetermined period of time, including while the superconducting coil is being charged to the superconducting state, and wherein an occurrence of a trigger event while the outward magnetic pressure is being imposed on the cryogenic container causes the cryogenic container to expand and burst into radially-dispersed fragments.

20. The apparatus of claim 19, further comprising:

an outer casing surrounding at least a lateral surface area of the cryogenic container, wherein an occurrence of the trigger event while the outward magnetic pressure is being imposed on the cryogenic container and the outer casing causes the cryogenic container and the outer casing to expand and burst into the radially-dispersed fragments.

* * * * *